United States Patent [19]

Langfield et al.

[11] 4,252,375

[45] Feb. 24, 1981

[54] WEAR OR THRUST PLATES FOR HYDRAULIC ROCK SPLITTING APPARATUS

[75] Inventors: Edward R. Langfield, 140 Elmwood Ave., Glen Rock, N.J. 07452; James L. Hile, Montville, N.J.

[73] Assignee: Edward R. Langfield, Glen Rock, N.J.

[21] Appl. No.: 74,429

[22] Filed: Sep. 11, 1979

[51] Int. Cl.[3] ..... E21C 37/04

[52] U.S. Cl. ..... 299/23; 299/22

[58] Field of Search ..... 299/22, 23

[56] References Cited

U.S. PATENT DOCUMENTS

| | | | |
|---|---|---|---|
| 3,414,328 | 12/1968 | Darda | 299/23 X |
| 3,894,772 | 7/1975 | Darda | 299/22 |
| 4,168,862 | 9/1979 | Langfield | 299/23 |

*Primary Examiner*—Ernest R. Purser
*Attorney, Agent, or Firm*—Ralph R. Roberts

[57] ABSTRACT

This invention pertains to hydraulically actuated rock splitters which utilize a wedge and feather action. The forward movement of this wedge places a corresponding thrust load on the feathers and their retaining means. Conventionally, the feathers have enlarged portions which are engaged by and are retained by hardened steel thrust or wear plates carried by a shell or housing. As a means of keeping the weight within reasonable limits this housing is usually made of aluminum or an alloy of aluminum. The support for these hardened steel plates, as provided by the housing, is usually insufficient resulting in a cracking or breaking of the hardened steel plates. These wear plates are made as laminations with a hardened steel plate disposed to engage the ends of the feathers and a softer steel backing plate which prevents damage to the housing when cracking of the hardened plate does occur. The embodiments show ring-like components arranged in a laminated assembly with no split in the wear plate component.

10 Claims, 7 Drawing Figures

WEAR OR THRUST PLATES FOR HYDRAULIC ROCK SPLITTING APPARATUS

CROSS REFERENCE TO RELATED APPLICATION

To the extent applicable this application pertains to the wear plates as shown in the application U.S. Ser. No. 867,026 as filed Jan. 5, 1978 and now U.S. Pat. No. 4,168,862 entitled "Wear or Thrust Plates for Hydraulic Rock Splitting Apparatus". The owner of application U.S. Ser. No. 867,026 is also the owner by assignment of the instant application.

BACKGROUND OF THE INVENTION

1. Field of the Invention

With reference to the classification of art as established in and by the United States Patent and Trademark Office, the present invention is believed to be found in the general class entitled, "Mining or in Situ Disintegration of Hard Material" (Class 299) and in the subclass entitled, "expansible breaking down devices-piston" (subclass 22) and the subclass using a "wedge" (subclass 23).

2. Description of the Prior Art

The use of a wedge and associated feathers for splitting rock is shown particularly in U.S. Pat. No. 3,957,309 to DARDA as issued on May 18, 1976 and in U.S. Pat. No. 4,114,951 as issued Sept. 19, 1978 to LANGFIELD, et al. These references are applicable to a hydraulically actuated rock splitter in which a tapered wedge is moved between opposed and contiguous feathers. Conventionally, the upper ends of these feathers are retained by housings of metal. On the thrust and splitting movement or action of the wedge there is a thrust load on the enlarged retaining ends of the feathers. This thrust load is conventionally transmitted by and through hardened steel plates to a housing retainer.

As reducer to practice, this hardened steel thrust or wear plate often cracks or breaks during or as a result of the thrust and splitting action movement of the tapered wedge. These wear or thrust plates are retained by grooves and/or screws. Under this thrust and when and where dirt, a rock or other material or factor reduce the ability of the wedge to slide along the face of the feathers an increase of pressure and a cracking or breaking of these wear plates results. Repeated actuation of the wedge to produce a splitting action often causes the cracked or brokenwear or thrust plates to cut or mutilate the housing or retainer, usually made of aluminum, to the extent that it is not satisfactorily useable.

In particular the housing or retainer used in th DARDA apparatus and as shown in the LANGFIED patent above identified utilizes an aluminum alloy. The wear or thrust plates are hardened steel and when broken or cracked the sharp edges of said wear plates cut or gouge portions of the retainer. Repeated use of the tool often causes the area of the housing retaining these broken wear plates to become cut or worn beyond accetable limits. The present invention provides an additional thrust plate of soft steel which may be bonded to the hardened steel plate by epoxy cement, silver soldering or brazing. In certain installations or applications the soft metal plate may be held in place by pins or screws and the hardened steel plate placed next to the softer steel plate. This results in the hardened steel plate being positioned between the soft steel plate and the enlarged end portions of the feathers.

When damage to the housing occurs from the cracking and further disintegration of the broken thrust plates takes place because of continued use of the rock splitter, repair of the housing is required. This rework of the housing occurs at the recess where the thrust plate is originally mounted. This rework consists of remachining of this recess to accommodate the additional thrust plate of softer steel. If the damage to the housing is extensive, a cutting away of the damaged portion may weaken the housing to a degree that is unsatisfactory. The housing then must be discarded or a rebuilding of the damaged area may be accomplished by welding and remachining.

The softer steel support plate is preferably made as one-quarter, five-sixteenths, three-eighths or sometimes as much as seven-sixteenths inch in thickness. This does not preclude a thickness of up to three-quarters of an inch which has proven satisfactory. The same contour on the outside as the hardened thrust plate is usually carried forth in the softer steel reinforcing support plate, to be hereinafter more fully described.

SUMMARY OF THE INVENTION

This invention may be summarized at least in part with reference to its objects.

It is an object of this invention to provide, and it does provide, a separate reinforcing thrust plate which in combination with the hardened steel plate provides a capacity to withstand the thrust imparted to the wedge of the splitter.

It is further object of this invention to provide, and it does provide, a reinforcing thrust plate which is combined with a conventional hardened steel thrust plate to provide a combined thrust plate which is fitted into a housing having a receiving recess which is enlarged to receive and retain this reinforced thrust plate.

In brief, this invention is directed to and toward the problem of cracking, breaking and the subsequent destroying of the seat in the housing by the broken hardened steel plate. A cutting of a deeper seating groove in the housing permits the use of a reinforced plate employing a second thrust plate of a much softer steel. This reinforced plate where and when initially employed in a housing allows or permits the hardened plate to crack and break without damage to the aluminum housing. The housing assembly, worth several hundred dollars, may be saved through rework of the housing. This rework may cost as little as a hundred dollars or so. The new thrust plate assemblies are little more expensive than a single thickness hardened steel plate. The laminated or combined wear plate assembly of this application is drawn to the making of each laminate as one complete washer or member. The laminate may have a circular or oval shape but is anticipated that the thickness will be substantially regular.

In addition to the above summary the following disclosure is detailed to insure adequacy and aid in understanding of the invention. This disclosure, however, is not intended to prejudice that purpose of a patent which is to cover each new inventive concept therein no matter how it may later be disguised by variations in form or additions of further improvements. For this reason there has been chosen embodiments of the improved thrust plates for hydraulic rock splitting apparatus as adopted for use in the lower housings of such apparatus and showing a preferred means for making a laminate structure. These specific embodiments have been chosen for the purpose of illustration and description as shown in the accompanying drawing wherein:

BRIEF DESCRIPTION OF THE DRAWING

In the following description and in the claims various details are identified by specific names for convenience. These names are intended to be generic in their application. Corresponding reference characters refer to like members throughout the several figures of the drawing.

Figure 2:
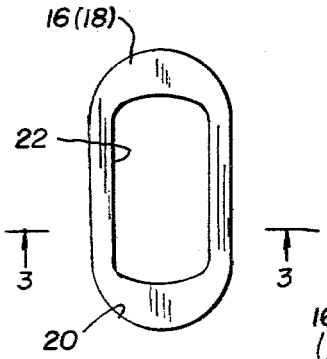
FIG. 2 represents a plan view of upper and lower feathers having an elliptical outer and inner configurations.

The drawing accompanying, and forming part of, this specification disclose details of construction for the purpose of explanation but sructural details may be modified without departure from the concept and principles of the invention and the invention may be incorporated in other structural forms than shown.

DESCRIPTION OF THE PREFERRED EMBODIMENT

Figure 1:
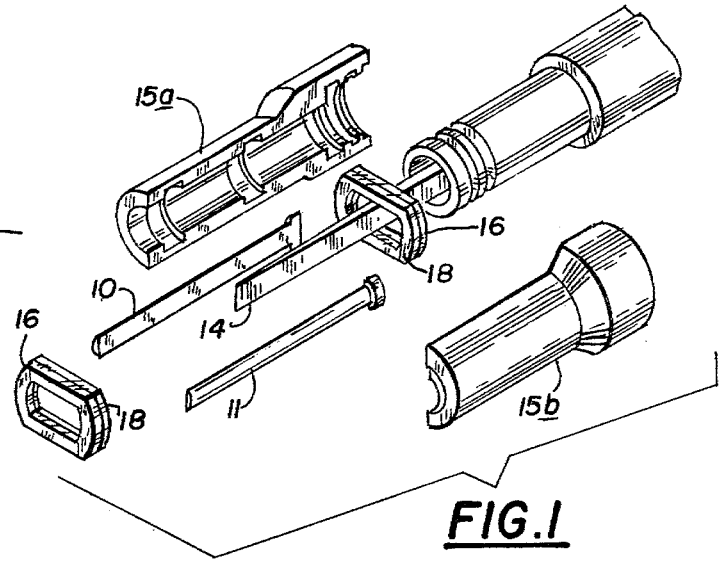
FIG. 1 represents a fragmentary, isometric view and showing upper and lower laminated wear plates of this invention as slid over and used with a pair of feathers and a wedge member.
Figure 3:
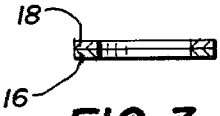
FIG. 3 represents a section view of the wear plates of FIG. 2, this view taken on line 3—3 thereof and looking in the direction of the arrows.

Referring now to FIG. 1 in particular, it is to be noted that feathers 10 and 11 which are conventional in construction and have enlarged ends which are more specifically shown in the above identified United States patents. Between these feathers is moved a wedge 14 to expand the feathers outwardly to make the split in the rock in a manner previously described in conjunction with the above identified patents. Normally the wedge 14 is moved by means of a hydraulic cylinder and a housing which also carries a lower assembly of split clamp shell half portions. 15 *a* and 15 *b* encloses these feather ends. In the present invention, as depicted in FIG. 1, a pair of wear plates 16 and 18 are formed of steel. The wear plate 18 is disposed next to the ends of the feather and is made of heardened tool steel. The wear plate 16 which is supportive of plate 18 is made of a softer steel having a greater modulus of elasticity. The wear plates 16 and 18 have their outer configuration depicted as simicircular ends and straight sides. The outer configuration can also be elliptical if desired to fit a determined cavity in a split camp shell recess as shown in the above identified U.S. Pat. No. 4,114,951. The inner configuration 22 as depicted has arcuate ends and straight sides but, of course, the inner configuration may be of any shape to conform to a desired enclosing and supporting of the ends of the wedges and feathers. In FIG. 3 it is to be noted that the upper and lower wear plate 18 and 16 are shown as substantially the same in thickness but the thickness of these plates may be increased or decreased to accommodate particular conditions of operation. Preferably the upper and lower wear plates are maintained in a desired relationship by means of pins, adhesive, silver solder or brazing.

WEAR PLATES AS SHOWN IN FIGS. 4 AND 5

Figure 4:
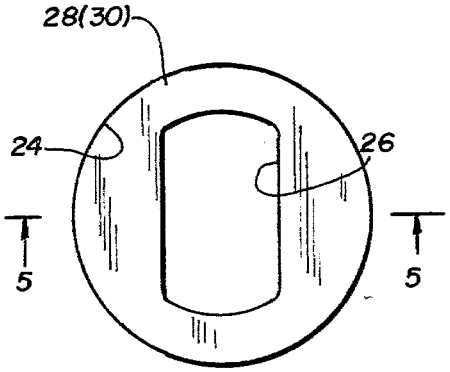
FIG. 4 represents a plan view of upper and lower wear plates having a circular outer configuration and an elliptical inner configuration.
Figure 5:
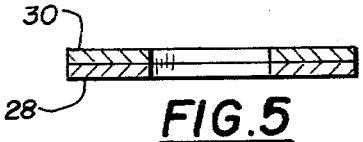
FIG. 5 represents a sectional view taken on the line 5—5 of FIG. 4 and looking in the direction of the arrows.

In FIGS. 4 and 5 the wear plates are depicted with an outer circular configuration 24 and an inner configuration 26 in which arcuate ends and parallel sides are provided. A lower plate 28 and upper plate 30 are made of similar or different thicknesses as desired with one plate made of hardened steel and the other plate made of a softer steel to provide the desired resistance to cracking as above explained. As in the cse of the wear plates of FIGS. 2 and 3 the wear plates can be laminated together and maintained in a together relationship by means of pins, adhesive, solder or brazing.

WEAR PLATES AS SEEN IN FIGS. 6 AND 7

Figure 6:
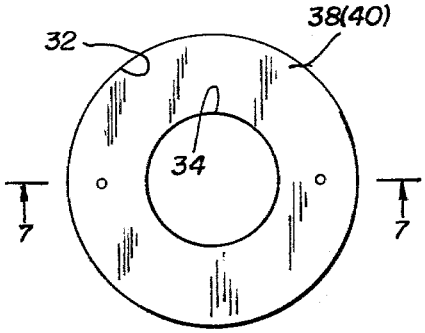
FIG. 6 represents a plan view of upper and lower wear plates in which both the inner and outer configurations are circular in shape.
Figure 7:
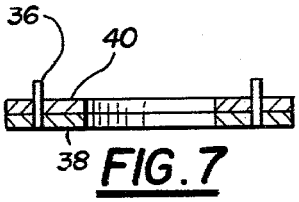
FIG. 7 represents a sectional view taken on line 7—7 of FIG. 6 and looking in the direction of the arrows.

Referring next and finally to the wear plates as shown in FIGS. 6 and 7 it is to be noted that an outer configuration 32 is circular in shape and the wear plate also has a circular inner configuration identified as 34. In order to maintain these plates in orientation, if adhesive, silver solder or brazing is not used, it is proposed that pins 36 be provided as a press fit in operatures formed in the lower and upper wear plates identified as 38 and 40.

It is realized, of course, that these wear plates may be held together by pins 36 such as shown in FIGS. 6 and 7 and orientation may be provided in a split clamp shell by means of holes formed in these clamp shells or if desired the pins may be made only of a length to accommodate the combined laminated thickness of the wear plates. The outer and inner configurations of the wear plates above depicted and described can be easily changed to accommodate the desired recess in the housing shell and also to accommodate the feathers and the ends of the feathers to be retained.

It is necessary and desired that the hardened steel portion of the combined wear plate is placed next to the protruding end of the feathers so as to bear the wear and initial thrust of the feathers as above described. The softer steel wear plate portion accommodates the wear plate when the hardened wear plate is cracked and prevents damage to the aluminum housing provided to retain the feathers.

The above described wear plates, arranged as a laminated pair, are shown to illustrate and claim the formation of laminated wear plates in which each portion of the upper and lower wear plate portions are made as one piece members.

In the embodiment shown in FIG. 1 it is contemplated that a split clamp shell housing will be provided as shown in the above referenced U.S. Pat. No. 4,114,951, but that is not to preclude the use of housings that have not been split for easy access and repair. It is contemplated that in each and every instance the groove for the wear plate will be of sufficient width to accommodate the laminated wear plate assembly in which the hardened steel plate is next to the enlarged end of the feather and the softer supportive wear plate is away from the enlarged end of the feathers. The laminated wear plate is needed and used at least in the groove below the enlarged end of the feathers since the maximum thrust load is produced during the foward movement of the wedge as it splits the rock. As reduced to practice the softer wear plate of the laminated assembly is a minimum of a quarter of an inch in thinkness and is often greater. The selected thickness is merely a matter of selection to accommodate specific requirements.

Terms such as "left", "right", "up", "down", "bottom", "top", "front", "back", "in", "out", and the like are applicable to the embodiments shown and described in conjunction with the drawing. These terms are merely for the purposes of description and do not necessarily apply to the position in which the rock splitter and the dual hardness thrust plates may be constructed or used.

While particular embodiments of the thrust plate reinforcement have been shown and described it is to be understood the invention is not limited thereto since modifications may be made within the scope of the accompanying claims and protection is sought to the broadest extent the prior art allows.

What is claimed is:

1. An improved thrust plate laminate assembly for use with hydraulically actuated rock splitters which utilize a wedge and feathers for the splitting of predrilled rock, the feathers characterized in that they have enlarged end portions which engage and are carried on appropriately formed and positioned thrust plate assemblies as the tapered wedge is moved to cause the feathers to move apart, this improved laminated thrust plate as used with a correspondingly formed receiving and retaining housing including split clamp shell half portions and including:

(a) an inner thrust plate of hardened steel and adapted to engage the enlarged end portion of a feather, this thrust plate of conventional form and size and of a unitary construction;

(b) an outer thrust plate of softer steel and of the same planer configuration as the inner thrust plate and also of unitary construction, the inner and outer wear plates of a contiguous and substantially aligned relationship with these two wear plates arranged as aligned and laminated members;

(c) a correspondingly shaped and sized retaining groove formed in the split clamp shell half portions of the housing the width of the formed groove sufficient to snugly retain both the hardened and the softer supportive wear plates when mounted therein, and (d) means for retaining both the harder and softer supportive steel wear plates in alignment and in a contiguous relationship as the wedge is moved to cause the free portion of the feathers to be moved outwardly.

2. An improved thrust plate laminate assembly as in claim 1 in which the outer configuration is ovoid in shape and the inner configuration of the through aperture is also ovoid in configuration.

3. An improved thrust plate laminate assembly as in claim 1 in which the outer configuration has semicircular end portions and the sides therebetween are substantially straight portions and the inner aperture has arcuate end portions and the portions therebetween are substantially straight extents.

4. An improved thrust plate laminate assembly as in claim 1 in which the outer configuration is substantially circular and the inner through aperture has arcuate ends and the portions therebeteween are substantially straight extents.

5. An improved thrust plate laminate assembly as in claim 1 in which the inner and outer configurations are substantially circular.

6. An improved thrust plate laminate assembly as in claim 5 in which the inner and outer circular configurations are at substantially the same origin.

7. An improved thrust plate laminate assembly as in claim 1 in which both the harder and softer wear plates are maintained in a desired coincidence by means of pins passing through each of the wear plates.

8. An improved thrust plate laminate assembly as in claim 7 in which the pins extend from one side to provide positioning means of the wear plate laminate assembly in the housing.

9. An improved thrust plate laminate assembly as in claim 1 in which the softer steel wear plate is at least one-quarter inch thick.

10. An improved thrust plate laminate assembly as in claim 1 in which the harder and softer steel plates are laminated and retained together by means such as epoxy cement, soldering, brazing and the like.

* * * * *